United States Patent [19]

Ohno

[11] Patent Number: 4,707,108

[45] Date of Patent: Nov. 17, 1987

[54] IMAGE FORMING APPARATUS HAVING MOVABLE DEVELOPING MEANS AND MEANS FOR REMOVING DEVELOPER THEREFROM

[75] Inventor: Akio Ohno, Tokyo, Japan

[73] Assignee: Canon Kabushiki Kaisha, Tokyo, Japan

[21] Appl. No.: 833,617

[22] Filed: Feb. 27, 1986

[30] Foreign Application Priority Data

Mar. 1, 1985 [JP] Japan ..... 60-38695

[51] Int. Cl.[4] ..... G03G 15/09; G03G 15/01

[52] U.S. Cl. ..... 355/4; 355/3 DD; 118/645; 118/657

[58] Field of Search ..... 355/4, 3 DD, 3 R; 118/645, 657, 658

[56] References Cited

FOREIGN PATENT DOCUMENTS 111555 7/1982 Japan ..... 355/4

*Primary Examiner*—R. L. Moses

*Attorney, Agent, or Firm*—Fitzpatrick, Cella, Harper & Scinto

[57] ABSTRACT

An image forming apparatus includes a developing device for developing a latent image formed on an image bearing member. The developing device is movable between a developing position wherein it is effective to develop the latent image and a developer collecting position wherein the developer within the developing device can be removed therefrom and collected. The developing device can take one of those positions. When the developer is to be removed and collected from the developing device, the developing device is moved to the collecting position, and then the developer is removed and collected from the developer disposed at the developer collecting position.

35 Claims, 11 Drawing Figures

IMAGE FORMING APPARATUS HAVING MOVABLE DEVELOPING MEANS AND MEANS FOR REMOVING DEVELOPER THEREFROM

FIELD OF THE INVENTION AND RELATED ART

The present invention relates to an image forming apparatus, more particularly, to an image forming apparatus comprising a plurality of developing devices which contain different color developers. The present invention is preferably usable with an image forming apparatus, such as a copying machine by which monochromatic images in different colors (two or more) or a full color image can be provided. However,the present invention is not limited to such a machine, but usable with various kinds of copying machines, or with a multi-color printer which constitutes an output station of a computer or facsimile machine.

In a developing device using a developer, particularly a so-called two component developer containing toner particles and carrier particles, it is well known that the developer, particularly the carrier, is deteriorated with the use thereof, with the result of the necessity of periodically replacing the developer in the developing device with fresh developer. In order to facilitate the replacement of the developer, it is known, as disclosed in Japanese Patent Application Publication 28263/1975, that a fixed developing device defines a circulation path for the developer, wherein a part of the circulation path is opened, and then the deteriorated developer particles are conveyed to the outside by a conveying means such as a screw, and the developer particles are collected. In the above method of collecting the deteriorated developer, however, the developer is collected at the developing station where the developing device is opposed to an image bearing member which is the member to be acted on thereby during developing operation, and therefore, when the screw and a developing roll is driven for the collection, the developer particles may spill through the clearance between the developing roll and the image bearing member which is stopped. The spilled particles contaminate the inside of the machine. Additionally, during the collecting operation, the developer particles are in sliding contact with the same portion of the image bearing member, resulting in an adverse affect to the image bearing member.

Those drawbacks may be avoided if the developer is collected while the image bearing member is moving. However, since the developer then tends to be deposited onto the surface of the moving image bearing member, an electric control such as the application of a bias voltage, is required so as to prevent the deposition. This results in the complicated operational sequences for the collection, and in addition, there is a problem of safety in the collecting operation.

Further, as only the screw is rotated without rotating the developing roll during the collecting operation, there arises a problem that the developer deposited on the developing roll can not be removed.

SUMMARY OF THE INVENTION

Accordingly, it is a principal object of the present invention to provide an image forming apparatus wherein the developer is removed and collected without difficulty from the developing device thereof.

It is another object of the present invention to provide an image forming apparatus wherein the developer is removed and collected at a position away from the developing station, thus avoiding the possibility of damage to the image bearing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in detail in conjunction with the accompanying drawings. In the description, a full color copying machine will be taken as an example of the image forming apparatus according to the present invention. It should be noted, however, that the present invention is also applicable to a multi-color copying machine, and a color recording device used as an output station of a computer or the like.

Figure 1:
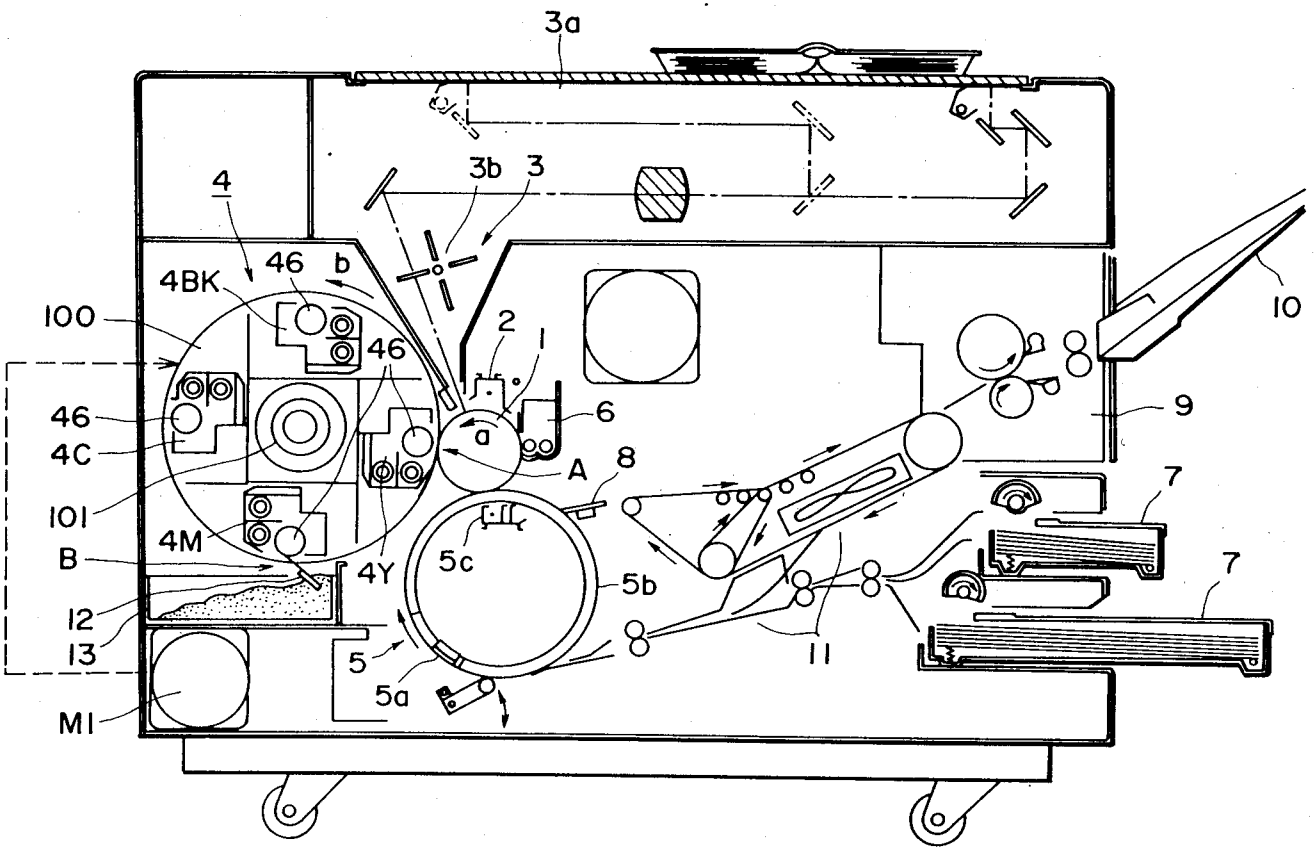
FIG. 1 is a somewhat schematic sectional view of a full color image forming apparatus according to an embodiment of the present invention.

Referring now to FIG. 1, there is shown a full-color copying machine as an example of the image forming apparatus for forming full color images. The apparatus comprises an electrostatic latent image bearing member in the form of a photosensitive drum 1 which is subjected to the developing operation. The photosensitive drum 1 is rotatable in the direction indicated by an arrow a. Around the photosensitive drum 1, there are provided a charger 2, an exposure optical system 3, a developing assembly 4, an image transfer system 5 and a cleaning device 6. The optical system 3 comprises a portion 3*a* for scanning the original to be copied and a color-separating filter 3*b*. The developing assembly 4 includes, for example, a yellow developing device 4Y containing yellow toner, a magenta developing device 4M containing magenta toner, a cyan developing device 4C containing cyan toner and a black developing device 4BK containing black toner. In this embodiment, the developing assembly 4 has a rotor 100 rotatable about a central shaft 101. The rotor 100 supports thereon along the periphery thereof the developing devices 4Y, 4M, 4C and 4BK, which are detachable from the rotor 100 by drawing them in the direction perpendicular to the sheet of the drawing of FIG. 1. They are circumferentially spaced by approx. 90 degrees. During the developing operation, the rotor 100 is driven by a driving motor M1 so that the rotor 100 rotates in the direction indicated by an arrow b about the central shaft 101, thus a desired one of the developing devices 4Y, 4M, 4C and 4BK is placed at the developing position A opposed to the photosensitive drum 1.

Figure 9:
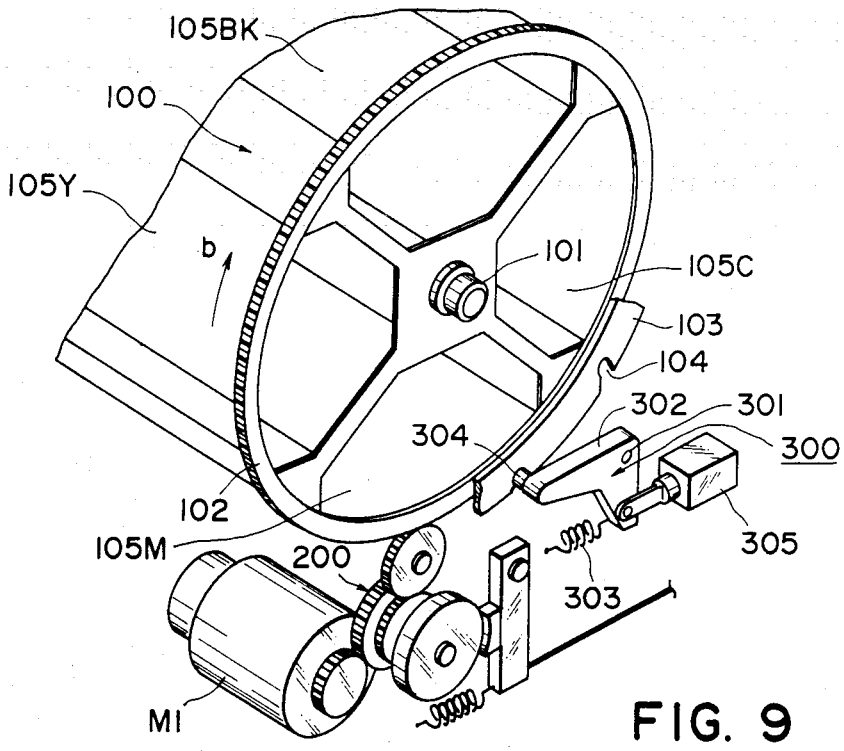
FIG. 9 is a perspective view of a driving mechanism for driving a rotor.

Referring to FIG. 9, the driving of the rotor 100 will be described. The rotor 100 is provided with a ring gear 102 at its rear side and is driven by a driving motor M1 disposed in the copying machine through a gear train 200 meshed with the ring gear 102. Thus, those elements constitute a driving means for the rotor 100. The correct positioning of the rotor 100 is effected by a positioning means 300 including a crank arm 302 which is pivotable about a pivot 301. A spring 303 is engaged adjacent an end of the crank arm 302 so as to urge a pin 304 fixed adjacent the other end of the crank arm 302 toward a positioning ring 103 fixed on the rotor 100. The positioning ring 103 is provided with grooves 104 on the periphery thereof. When the rotor 100 is rotated so as to align one of the grooves 104 with the pin 304, the spring 303 is effective to pivot the crank arm 302. By this, the pin 304 engages the groove 104 to prevent the further rotation of the rotor 100.

The crank arm 302 is operatively connected with a solenoid 305, which is effective upon energization to draw the crank arm 302 against the spring force of the spring 303, whereby the pin 304 is disengaged from the slot 104. By this, the rotor 100 becomes rotatable. By the above structures, the rotor 100 is rotated and stopped at proper positions so that a desired one of the developing devices 4Y, 4M 4C and 4BK can be moved and placed at the developing station.

Further, there are provided developer supporting members 105Y, 105M, 105C and 105BK, mounted on the rotor 100 to detachably support the developing devices 4Y, 4M, 4C and 4BK, respectively. In FIG. 9, the assembly is shown having all of the developing devices detached.

Referring back to FIG. 1, the rotor 100 is shown as taking such a position that the developing device 4Y is placed at the developing position A. In this embodiment, the developing devices are moved by the rotation of the rotor 100. However, it is a possible alternative that the developing devices are mounted on an endlessly movable member so as to move the developing devices along a non-circular path.

The image transfer system 5 includes an image transfer drum **5*b* having a gripper 5*a*, and further includes a transfer charger 5*c* disposed inside the transfer drum 5*b***.

In an operation for providing a full color image, the photosensitive drum is uniformly charged by the charger 2 and is exposed to color-separated image light through the exposure optical system 3, so that an electrostatic latent image is formed on the photosensitive drum 1. The electrostatic latent image is developed by the developing device which has been placed in the developing position A and which contains the toner corresponding to the color component of the color separated image light. Then, the developed image is transferred by the transfer charger **5*c* onto a transfer material which has been fed to and supported on the transfer drum 5*b*. The above-described steps are repeated plural times in accordance with the color components so that the developed images of different colors are transferred sequentially onto the same transfer material. The transfer material which has received the final color image is separated from the transfer drum 5*b* by the separating means 8 and is conveyed to a fixing device 9 where the toner image is fixed on the transfer material. Then, the transfer material is discharged to the tray 10. Thus, a full color image is formed on the transfer material correspondingly to the original image. On the other hand, the photosensitive drum 1 from which the final color image has been transferred onto the transfer material is cleaned by the cleaning device 6 which is effective to remove the remaining toner from the photosensitive drum 1. The photosensitive drum 1 is cleaned after each of the transfer operations for different colors. The transfer material is fed to the transfer drum from the cassette 7. The transfer material is conveyed by a conveyor 11**.

As shown in FIG. 1, a scraper 12 and a container 13 for collecting the developer removed from the developing device are disposed below the developing device 4M. The scraper 12 can be brought into and out of contact with the developing roller 46 of each of the developing devices. During the image forming operation of the apparatus, the scraper 12 is situated away from the developing, roller 46, whereby it is outside the path of the developing device 4. When the developer is to be collected from one of the developing devices, the scraper 12 is contacted to the developing roller 46. The container 13 is removable mountable in the image forming apparatus so as to allow the collected developer to be removed therefrom and then to be disposed of. The operation of the developer collection will be described in detail hereinafter.

The structures of the developing devices 4Y, 4M, 4C and 4BK will be described. Since those developing devices have the same structure, the developing device 4Y which is shown as being situated at the developing position A, will be described in conjunction with FIG. 2.

Figure 2:
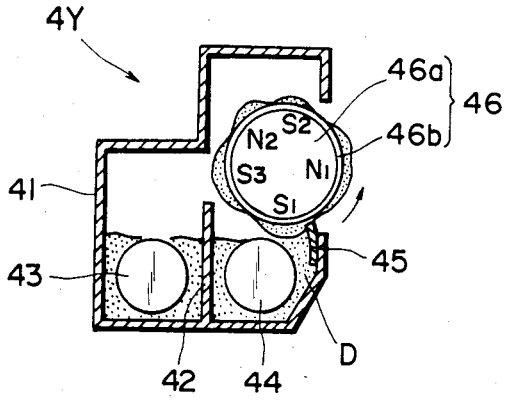
FIG. 2 is a sectional view illustrating the structure of the developing device of the FIG. 1 apparatus.

FIG. 2 shows the developing device 4Y in the state of being removed from the rotor 100. The developing device 4Y includes a developer container 41, which is divided into two chambers by a partition 42. The chambers are provided with rotatable conveying screws 43 and 44, respectively. The screws 43 and 44 serve to reciprocate or circulate the developer in the container 41 in the longitudinal direction of the container 41. In this embodiment, the developer D is a so-called magnetic two-component developer containing toner particles and carrier particles. On the other hand, the developing roller 46 in this embodiment includes, as shown, a fixed magnet roller **46*a* and a developing sleeve 46*b* enclosing the magnet roller 46*a* and rotatable in the direction indicated by an arrow to carry thereon the developer. In this embodiment, the magnet roller 46*a* is stationary, while the developing sleeve 46*b* is rotatable. However, this is not limiting, and it is possible to relatively rotate the magnet roller 46*a* and the developing sleeve 46*b*. Further, the developing roller 46 may be a magnet roller having plural poles. In this embodiment, the developing device includes the developing roller having a magnetic means such as a magnet roller, so that the developing devices are revolved by the rotation of the rotor 100**, the toner is prevented from scattering by the magnetic field provided by the magnetic means.

During the rotation of the developing sleeve 46*b*, the developer is taken up by the magnetic pole S1, is regulated in thickness on the developing sleeve 46*b* by a doctor blade 45, and is conveyed or carried on the sleeve surface by way of poles N1, S2, N2 and S3. The magnetic pole N1 is the main developing pole, which is effective to form a magnetic brush which may contact the electrostatic latent image on the photosensitive drum 1 to develop it. By a repelling magnetic field formed between the magnetic pole S3 and the pole S1, the developer on the developing sleeve 46*b* is removed from the sleeve surface to fall into the container.

The developing devices each having the structure described above are revolved in a manner such that the developing rollers always face outwardly adjacent the rotor 100. Thus, the developing devices are sequentially brought to the developing position. The developing device situated at the developing position develops the electrostatic latent image formed by the color separated image light. The developer, however, deteriorates with the use thereof, that is, with the integrated number of image forming operations increasing. Particularly, the carrier portion of the developer is deteriorated. Therefore, it is necessary to periodically replace the deteriorated developer with new developer. In the present invention, when the developer is to be collected for replacement, the developing device containing the developer to be replaced is first moved to a developer collecting position.

Figure 3:
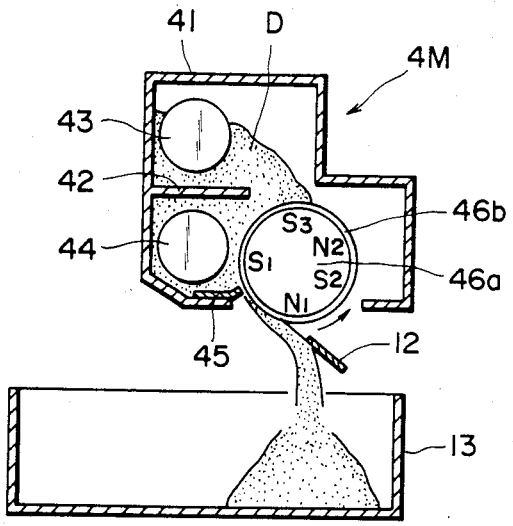
FIG. 3 is a sectional view illustrating the developing device situated in the developer collecting position.

The collection of the developer will be described. In this embodiment, shown in FIG. 1, the developer collecting position B is the position occupied by the developing device 4M, that is, the position taken by the developing device 4Y indicated as being located at the developing position A, when it is rotated through 90 degrees in the clockwise direction. When control means (not shown) produces developer collecting instructions, the developing device 4M, for example, is moved to the developer collecting position B. This is shown in FIG. 3. And, upon the production of the developer collecting instructions, the scraper 12 is press-contacted to the developing roller 46 of the developing device 4M. Aalso, the driving force required for the developer collection is transmitted only to the developing device 4M.

The mechanism for the engagement and disengagement of the scraper 12 with respect to the developing roller and the drive transmission mechanism to the developing device will be described in detail hereinafter. When the driving force is transmitted to the developing device 4M, the conveying screws 43 and 44 of the developing device 4M rotate, and the developing sleeve 46*b*, of the developing roller 46 also rotates. In this manner, the developer is carried on the surface of the developing sleeve 46*b*. Since the scraper 12 is press-contacted to the surface of the developing sleeve 46*b* as shown in FIG. 3, the carried developer is removed from the surface of the developing sleeve 46 by the scraper. The removed developer falls to a point beyond the influence of the magnetic field provided by the magnet roller 46*a*, disposed within the developing sleeve 46*b*, and falls into the collecting container 13 by gravity, the container 13 being disposed below the developing device 4M. The developer existing around the conveying screw 43 is stirred and moved by the rotation of the conveying screw 43 and is deposited at the conveying screw 44, beyond the partition 42, by gravity. The developer around the conveying screw 44 is drawn up to the surface of the developing sleeve 46*b* from the bottom portion thereof, is conveyed out of the developer container, and falls into the collecting container 13. By this operation, the developer within the developer container and on the developing sleeve is effectively collected.

Figure 4:
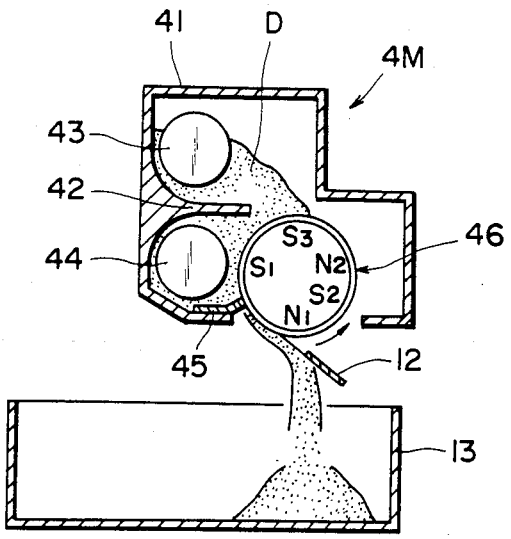
FIGS. 4 and 5 are sectional views of a developing device situated in the collecting position in an apparatus according to another embodiment of the present invention.
Figure 5:
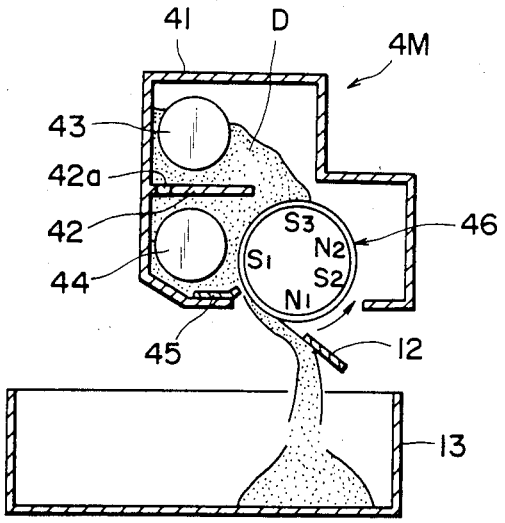

Further, in order to increase the collecting efficiency of the developer, the partition 42, may be contoured so as to be in conformity with the conveying screws 43 and 44, as shown in FIG. 4, thus making the movement of the developer easier. Additionally, it is also possible that an opening 42 may be formed in the partition 42, as shown in FIG. 5, so that the developer around the conveying screw 43 is more easily moved toward the conveying screw 44. It is also possible that the FIGS. 4 and 5 arrangements may be combined.

The developer collecting instructions may be generated by manually actuating the developer collecting mode switch provided for each of the developing devices on an operating panel of the image forming apparatus, for example. Alternatively, the deterioration of the developer in each of the developing devices may be and, in accordance with the detection, the developer collecting instructions may be automatically generated. In any case, in accordance with the collecting instructions, the developing device requiring the collection of the developer therein is moved to the developer collecting position B by rotating the rotor 100.

An example of the driving system for the developing device will be described in conjunction with FIGS. 6 and 7. In these Figures the rotor 100 is omitted for the sake of simplicity of illustration.

Figure 6:
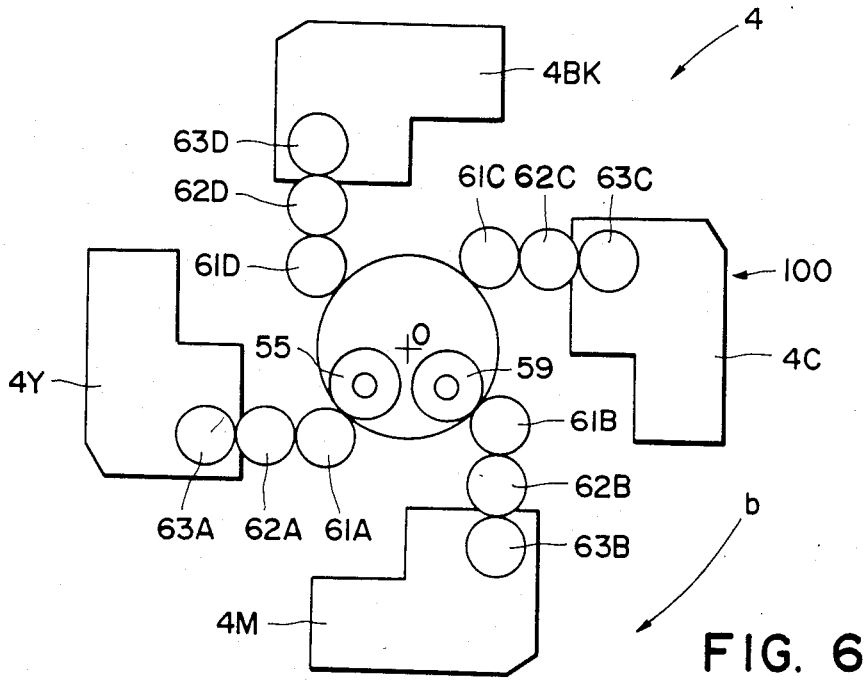
FIG. 6 illustrates the transmission of driving power to the developing device.
Figure 7:
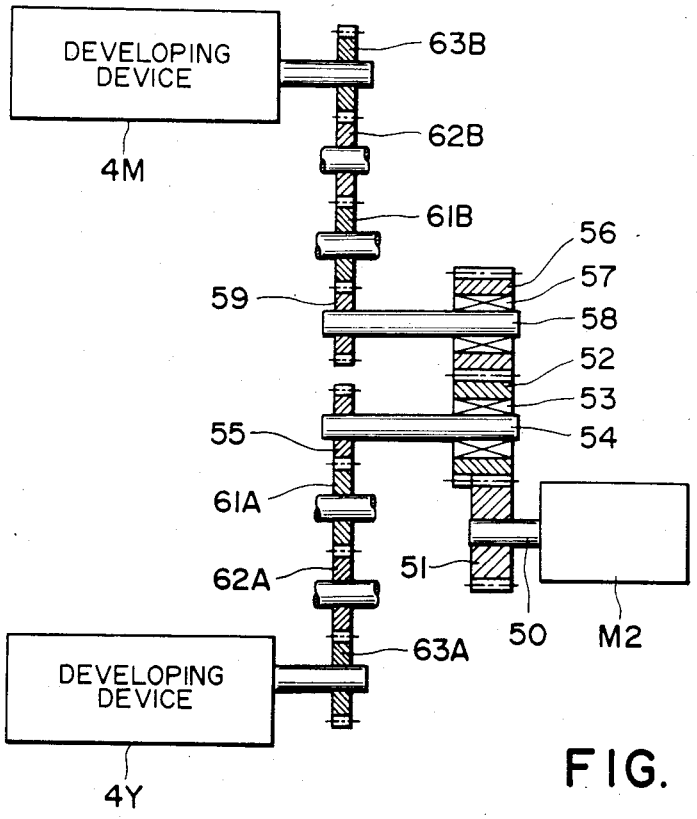
FIG. 7 is a sectional view illustrating the switching of the drive transmission to the developing device which is movable between the developing station and the collecting station.

FIG. 6 is a rear view of the rotatable developing assembly 4 shown in FIG. 1, wherein the driving mechanism for the developing device is shown. The driving mechanism includes gears 61A, 61B, 61C and 61D, and gears 62A, 62B, 62C and 62D, which are relaying gear supported on the rotor 100. Those relaying gears are effective to transmit the driving force from the input gears 55 and 59 to the input gears 63A, 63B, 63C and 63D of each of the developing devices. The gears 61A, 62A and 63A are for the developing device 4Y; the gears 61B, 62B and 63B are for the developer 4M; the gears 61C, 62C and 63C are for the developing device 4C; and the gears 61D, 62D and 63D for the developing device 4BK. When the driving force is transmitted to any one of the gears 63A, 63B, 63C and 63D, the developing roller (the developing sleeve 46B in this embodiment) and the conveying screws 43 and 44 of the associated developing device are driven.

The meshing engagement between the relaying gear 61A (61B, 61C, 61D) and the relaying gear 62A (62B, 62C, 62D) and the meshing engagement between the relaying gear 62A (62B, 62C, 62D) and the input gear 63A (63B, 63C, 63D) are maintained while it is revolving about the center O of the rotor 100. The input gears 55 and 59 are disposed at predetermined positions outside the rotor 100, and therefore, they do not rotate together with the rotation of the rotatable member 100. Rather, they are waiting for one of the relaying gears 61A, 61B, 61C and 61D coming thereto with rotation of the rotatable member 100. As shown in FIG. 7, the input gear 55 receives the driving force from the driving motor M2 through the gear 51 mounted to the output shaft 50 of the motor M2, a one way clutch 53 and the shaft 54 of the gear 52. On the other hand, the input gear 59 receives the driving force from the driving motor M2 through the gear 51 mounted to the output shaft 50 of the motor M2, a gear 52, a gear 56, a one way clutch 57 and a gear 56 mounted to the shaft 58. Here, the input gear 55 serves to transmit the driving force to a developing device, the developing device 4Y in the state shown in the Figure, located at the developing position, A, to drive it for the developing operation. The input gear 59 is effective to transmit the driving force to a developing device, the developing device 4M in the state shown in the Figure, located at the developer collecting position B, to drive it for developer collection.

The one way clutch 53 between the gear 52 and its shaft 54 and the one way clutch 57 between the gear 56 and its shaft 58 serve to transmit the rotation to the shaft 54 and shaft 58, respectively, only in the rotation of one direction. The transmitting directions of the one way clutches 53 and 57 are the same. The one way clutches 53 and 57 are built into the gears 52 and 56, respectively, the gears 52 and 56 being meshed with each other. Therefore, the rotating directions of the gears 52 and 56 are opposite to each other, whereby when one of the one way clutches 53 and 57 is operating, the other one way clutch does not transmit the driving force to its associated shaft. For example, it is assumed that when the driving motor M2 rotates in its forward direction, the one way clutch 53 transmits the driving force to the shaft 54. In this state, the gear 56 rotates in the direction opposite to that of the gear 52, with the result that the one way clutch 57 merely slides on the shaft 58, and therefore, the driving force is not transmitted to the shaft 58. When, on the contrary, the driving motor M2 rotates in the reverse direction, the one way clutch 53 does not transmit the driving force to the shaft 54, and therefore, the driving force is transmitted only to the shaft 58 through the one way clutch 57.

In this manner, the driving force from a single driving source is selectively transmitted by switching the direction of rotation of the driving motor M2 to the developing device disposed at the developing station A and the developing device disposed at the developer collecting position B. Therefore, upon the developing operation the driving motor M2 is rotated in its forward direction so that only the input gear 55 is driven so that only the developing device 4Y at the developing position A is driven. Conversely, upon the developer collection, the driving motor M2 is reverse rotated so that only the input gear 59 is driven, whereby the developing device 4M at the developer collecting position B is driven.

In this embodiment, different driving motors M1 and M2 are used for driving the rotor 100 and for driving the developing devices. However, a common driving source may be used. The description will be made as to the mechanism for moving the scraper 12 toward and away from the developing roller 46.

Figure 8:
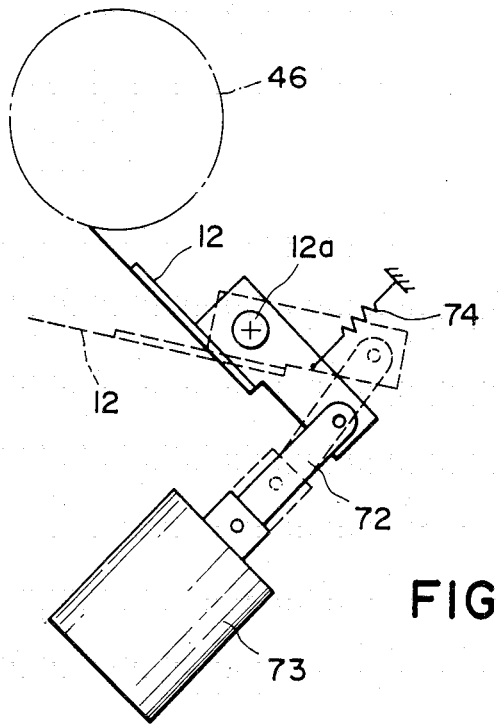
FIG. 8 illustrates the structure of the mechanism for driving a scraper.

FIG. 8 illustrates the structure and operation of the scraper 12 which normally takes the position indicated by broken lines by an urging force of a spring 74 mounted on an unshown image forming apparatus. In compliance with developer collecting instructions, the solenoid 73 is energized so as to pivot the scraper 12 about a shaft 12*a* against the spring force of the spring 74, whereby it is shifted to the position indicated by solid lines. In this position, the edge of the scraper 12 is press-contacted to the developing roller 46 of the developing device disposed at the developer collecting position B at this time. When the driving systems described in conjunction with FIGS. 6 and 7 drive the developing roller and the conveying screws of the developing device at the developer collecting position B, the deteriorated developer in the developing device is removed and collected in the collecting container 13 (not shown).

The scraper 12 normally (when not collecting the developer) takes the broken line position which is outside the rotating path of the developing devices so as not to obstruct rotation of the rotor 100 to set a desired developing device at the developing position.

Figure 10A:
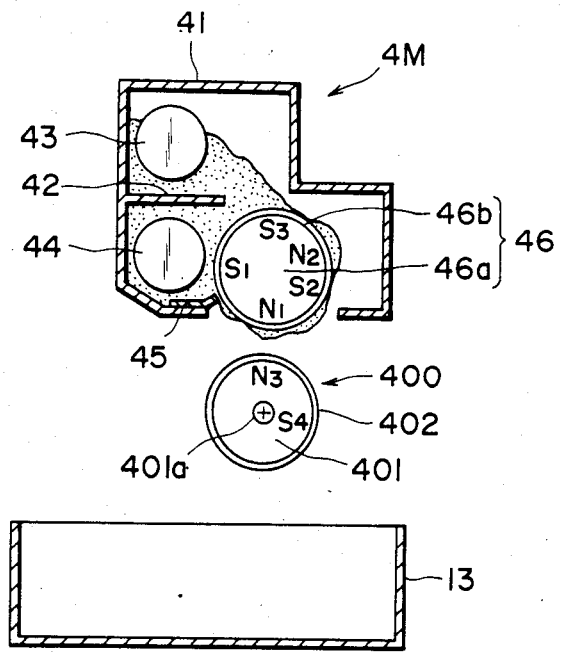
FIGS. 10A and 10B are sectional views illustrating another method of collecting the developer from the developing device.
Figure 10B:
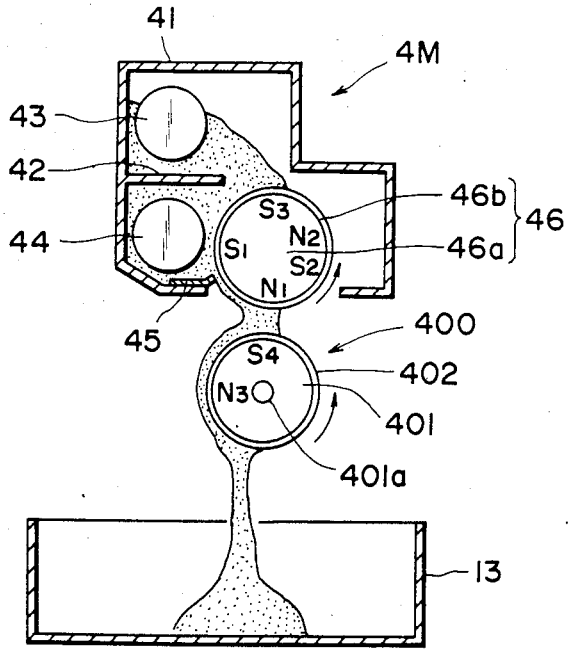

FIGS. 10A and 10B illustrate a developing device according to another embodiment of the present invention. In this embodiment, a magnetic force provided by a magnetic field generating means is used to move the developer from the developer roller and to collect the same.

As shown in FIG. 10, a collecting roller 400 as the magnetic field generating means is disposed adjacent to and opposed to the developing roller 46 of the developing device (the eveloping device 4M in this Figure) positioned at the developer collecting position. The collecting roller 400 includes a magnet member 401 having at least an N3 pole and S4 pole and a sleeve 402 rotatable around the magnet member 401.

When the developer is not being collected, the magnetic pole N3 of the magnet member 401 is located opposite to the magnetic pole N1 of the magnet roller 46A of the developing roller 46. Therefore, between the developing roller 46 and the collecting roller 400, a repelling magnetic field is formed by the magnetic pole N1 and the magnetic pole N3. By this magnetic field, the magnetic developer on the developing sleeve 46B is not pulled toward the collecting roller 400.

On the other hand, when the developer is to be collected, the magnet member 401 of the collecting roller 400, as shown in FIG. 10B, is rotated so that the magnetic pole N1 of the magnet roller 46A and the magnetic pole S4 of the magnetic member 401 are opposed. The developing sleeve 46B, the conveying screws 43 and 44, and the sleeve 402 are then rotated. The magnetic developer conveyed out of the developing device is attracted to the collecting roller 400 from the developing sleeve 46B by the functions of the N1 pole and the S4 pole. The developer attracted to the collecting roller 400 is conveyed in the direction of rotation of the sleeve 402, as shown to exceed the binding (influential) range of the magnetic field provided by the magnetic pole N3 of the magnet member 401. Then, by gravity, the developer falls into the container 13 from the sleeve 402. Thus, the developer within the developer container can be collected into the container 13.

In order to shift the positions of the magnetic poles N3 and S4 of the magnetic member 401, a shaft 401*a* fixed to the magnetic member, for example, is rotated by an unshown lever or solenoid. It is possible that a scraper is press-contacted to the collecting roller 400 so as to increase the efficiency of collection from the collecting roller 400.

As described, according to the present invention, the following advantages are provided:

(1) Since the developing position and the developer collecting position are different, the image bearing member is protected from possible damage during the developer collection;

(2) Since the developer can be collected at a position away from the image bearing member irrespective of movement of the image bearing member, the possibility of contaminating the apparatus is minimized;

(3) It is not necessary to use a particular member for the developer collection in the developing device, and therefore, the structure of the developing device is simplified;

(4) Since the developing device is moved to such a position that the developer can be collected by gravity, the developer can be efficiently removed and collected.

In the foregoing description, the present invention has been described with respect to a color copying machine provided with revolvable developing devices. The present invention is applicable to various kinds of image forming apparatus which contains a movable type developing device. Additionally, the foregoing description has been made on the assumption that the collected developer is the deteriorated developer. However, the present invention is not limited to this case, and it can be used in the case where a usable developer in the developing device is temporarily removed and collected for the purpose of maintenance of the developing device (for example, inspecting a toner concentration detecting element).

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

means for forming on said image bearing member a latent image in accordance with image information;

movable developing means for developing the latent image formed on said image bearing member by said latent image forming means, said developing means being movable between a developing position where said developing means develops the latent image on said latent image bearing member and a developer collecting position wherein the developer in said developing means is removed and collected therefrom; and removing means, cooperating with said developing means when it is located at said developer collecting position, for removing the developer from said developing means, wherein when the developer in said developing means is to be removed and collected, said developing means is moved to said developer collecting poisition to allow the developer to be removed therefrom by said removing means.

2. An apparatus according to claim 1, wherein said developing means includes a plurality of developing devices and a revolvable supporting member for support the developing devices, and wherein by revolution of the supporting member, a desired one of the plural developing devices is moved to the developer collecting position.

3. An apparatus according to claim 2, wherein said developing device includes a developer carrying member for carrying thereon the developer and supplying the developer to the latent image on the image bearing member, wherein when said developing device is moved to the developer collecting position, said developer carrying member is disposed below a center of revolution of said supporting member, and wherein when the developer is to be collected, said removing means acts on said developer carrying member to remove the developer from the developing device located at the developer collecting position.

4. An apparatus according to claim 2, wherein the developer collecting position is common to said plural developing devices.

5. An apparatus according to claim 2, wherein said plural developing devices contain different color developers, respectively.

6. An apparatus according to claim 2, wherein said plural developing devices are detachably mounted on said supporting member.

7. An apparatus according to claim 1, wherein the developer to be collected is deteriorated developer in said developing device.

8. An apparatus according to claim 7, wherein said developer is a two component developer including toner particles and carrier particles.

9. An apparatus according to claim 1, wherein said developer is magnetic.

10. An image forming apparatus comprising:

an image bearing member;

means for forming on said image bearing member a latent image in accordance with image information;

movable developing means for developing the latent image formed on said image bearing member by said latent image forming means, said developing means being movable between a developing position where said developing means develops the latent image on said latent image bearing member and a developer collecting position wherein the developer in said developing means is removed and collected therefrom, and said developing means including a plurality of developing devices and a revolvable supporting member for supporting the developing devices, said plural developing devices each including developer carrying means for carrying thereon the developer and supplying the developer to the latent image on said image bearing member, wherein by revolution of the supporting member, a desired one of the plural developing devices is movable to either of said developing position or said developer collecting position; and scraper means movable toward and away from a developer carrying means for a developing device in said developer collecting position, wherein when the developer in the desired one of said developing device is to be removed and collected, said desired one is moved to said developer collecting position to allow the developer to be removed therefrom, and said scraper means is press-contacted to the developer carrying means and the developer carrying means is rotated, so as to scrape the developer off the developer carrying means, whereby the developer is collected in a container for receiving the removed developer.

11. An apparatus according to claim 10, wherein the developer collecting position is common to said plural developing devices.

12. An apparatus according to claim 10, wherein said plural developing devices contain different color developers, respectively.

13. An apparatus according to claim 10, wherein said plural developing devices are detachably mounted on said supporting member.

14. An apparatus according to claim 10, wherein the developer to be collected is deteriorated developer in said developing device.

15. An apparatus according to claim 14, wherein said developer is a two component developer including toner particles and carrier particles.

16. An apparatus according to claim 10, wherein when the desired one said developing devices is moved to the developer collecting position, said developer carrying means is disposed below a center of revolution of said supporting member, and wherein when the developer is to be collected, the developer is removed from the developer carrying means of the desired one located at the developer collecting position with the aid of gravity.

17. An apparatus according to claim 10, further comprising a driving source for driving said developer carrying means when the developer is removed therefrom and for driving said developer carrying means when it supplies the developer therefrom to said image bearing member.

18. An apparatus according to claim 10, wherein said developing devices are supported by said revolvable supporting member such that each developer carrying means of said plural developing devices is always facing outward.

19. An apparatus according to claim 10, wherein said scaper means is retractable from a path of revolution of said developing devices.

20. An apparatus according to claim 10, wherein said developing devices each include conveying means for conveying the developer to said developer carrying means, and when the developer is removed and collected, said conveying means is rotated together with said developer carrying means.

21. An image forming apparatus comprising:

an image bearing member;

means for forming on said bearing member a latent image in accordance with image information;

movable developing means for developing the latent image formed on said image bearing member by said latent image forming means, said developing means being movable between a developing position where said developing means develops the latent image on said latent image bearing member and a developer collecting position wherein the developer in said developing means is moved and collected therefrom, and said developing means including a plurality of developing devices and a revolvable supporting member for supporting the developing devices, said plural developing devices each including developer carrying means for carrying thereon the developer and supplying the developer to the latent image on said image bearing member, wherein by revolution of the supporting member, a desired one of the plural developing devices is movable to either of said developing position or said developer collecting position; and magnetic field generating means opposed to a developer carrying means of a developing device in said developer collecting position, wherein when the developer in the desired one of said developing devices is to be removed and collected, said desired one is moved to said developer collecting position to allow the developer to be removed therefrom, and the developer is moved from the developer carrying means to said magnetic field generating means by a magnetic field formed between said developer carrying means and said magnetic field generating means, whereby the developer is collected in a container for receiving the removed developer.

22. An apparatus according to claim 21, wherein when the developer is not to be collected, a magnetic pole is switched so as not to form an attracting magnetic field between said developer carrrying means and said magnetic field generating means.

23. An apparatus according to claim 22, wherein when the developer is not collected, a repelling magnetic field is formed between said developer carrying means and said magnetic field generating means.

24. An apparatus according to claim 21, wherein when the developer is collected, said developer carrying menas is rotated.

25. An apparatus according to claim 21, wherein said magnetic field generating means includes a magnetic member and a sleeve rotatable around the magnetic member, and when the developer is to be collected, said developer carrying means and said sleeve rotate.

26. An apparatus according to claim 25, wherein said developer carrying means and said sleeve rotate such that the peripheral movements thereof are in opposite directions proximate to each other.

27. An apparatus according to claim 21, wherein the developer collecting position is common to said plural developing devices.

28. An apparatus according to claim 21, wherein said plural developing devices contain different color developers, respectively.

29. An apparatus according to claim 21, wherein said plural developing devices are detachably mounted on said supporting member.

30. An apparatus according to claim 21, wherein the developer to be collected is deteriorated developer in said developing device.

31. An apparatus according to claim 30, wherein said developer is a two component developer including toner particles and carrier particles.

32. An apparatus according to claim 21, wherein said developer is magnetic.

33. An apparatus according to claim 21, further comprising a driving source for driving said developer carrying means when the developer is removed therefrom and for driving said developer carrying means when it supplies the developer therefrom to said image bearing member.

34. An apparatus according to claim 21, wherein said developing devices are supported by said revolvable supporting member such that each developer carrying means of said plural developing devices is always facing outward.

35. An apparatus according to claim 21, wherein said developing devices each include conveying means for conveying the developer to said developer carrying means, and when the developer is removed and collected, said conveying means is rotated.

* * * * *

UNITED STATES PATENT AND TRADEMARK OFFICE

CERTIFICATE OF CORRECTION

PATENT NO. : 4,707,108

DATED : November 17, 1987

INVENTOR(S) : AKIO OHNO

It is certified that error appears in the above-identified patent and that said Letters Patent is hereby corrected as shown below:

COLUMN 1

Line 48, "affect" should read --effect--.

COLUMN 3

Line 37, "4M 4C" should read --4M, 4C--.

COLUMN 4

Line 27, "developing," should read --developing--.

COLUMN 5

Line 43, "Aalso," should read --Also,--.
Line 53, "46b," should read --46b--.
Line 56, "46b" should read --46b,--.

COLUMN 6

Line 8, "42," should read --42--.
Line 12, "opening 42" should read --opening 42a--.
Line 22, "be" should read --be detected--.
Line 37, "gear" should read --gears--.
Line 43, "developer 4M;" should read --developing device 4M;--.

COLUMN 8

Line 13, "move" should read --remove--.
Line 19, "eveloping" should read --developing--.
Line 45, "shown to" should read --shown, to--.

UNITED STATES PATENT AND TRADEMARK OFFICE

CERTIFICATE OF CORRECTION

PATENT NO. : 4,707,108

DATED : November 17, 1987

INVENTOR(S) : AKIO OHNO

It is certified that error appears in the above-identified patent and that said Letters Patent is hereby corrected as shown below:

COLUMN 9

Line 12, "contains" should read --contain--.

COLUMN 10

Line 48, "device" should read --devices--.

COLUMN 11

Line 5, "one said" should read --one of said--.
Line 35, "said bearing" should read --said image bearing--.

COLUMN 12

Line 19, "menas" should read --means--.

Signed and Sealed this

Twenty-eighth Day of February, 1989

*Attest:*

DONALD J. QUIGG

*Attesting Officer*

*Commissioner of Patents and Trademarks*